US012799655B2

(12) United States Patent
Yao

(10) Patent No.: US 12,799,655 B2
(45) Date of Patent: Nov. 17, 2026

(54) LIGHT-REFLECTIVE PATTERN

(71) Applicant: CHANCE LINE INDUSTRIAL CO., LTD., Siansi Township (TW)

(72) Inventor: Ming-Hsien Yao, Siansi Township (TW)

(73) Assignee: CHANCE LINE INDUSTRIAL CO., LTD., Siansi Township (TW)

( * ) Notice: Subject to any disclaimer, the term of this patent is extended or adjusted under 35 U.S.C. 154(b) by 267 days.

(21) Appl. No.: 18/658,684

(22) Filed: May 8, 2024

(65) Prior Publication Data

US 2025/0019880 A1 Jan. 16, 2025

(30) Foreign Application Priority Data

Jul. 14, 2023 (TW) ..... 112126417

(51) Int. Cl.
*D05C 17/00* (2006.01)

(52) U.S. Cl.
CPC ..... *D05C 17/00* (2013.01); *D10B 2401/20* (2013.01); *D10B 2403/01* (2013.01)

(58) Field of Classification Search
CPC .. G02B 5/128; D05C 17/00; A41D 19/01558; A41D 19/0157; B32B 3/26; B32B 3/266; B32B 5/24
See application file for complete search history.

(56) References Cited

U.S. PATENT DOCUMENTS

| | | | | |
|---|---|---|---|---|
| 2007/0184238 | A1* | 8/2007 | Hockaday | B32B 23/08 428/98 |
| 2014/0022641 | A1* | 1/2014 | Yoon | G02B 5/128 359/538 |
| 2018/0066922 | A1* | 3/2018 | Howland | B32B 23/10 |
| 2021/0246584 | A1* | 8/2021 | Stevens | A43B 23/0205 |
| 2024/0175767 | A1* | 5/2024 | Sun | G01L 1/18 |

FOREIGN PATENT DOCUMENTS

| | | | | |
|---|---|---|---|---|
| CN | 216100860 | U | 3/2022 | |
| EP | 2591688 | A1 * | 5/2013 | A41D 19/0157 |
| TW | 201924923 | A | 7/2019 | |

* cited by examiner

*Primary Examiner* — Jonathan Y Jung
(74) *Attorney, Agent, or Firm* — MUNCY, GEISSLER, OLDS & LOWE, P.C.

(57) ABSTRACT

A light-reflective pattern, disposed on a surface of a sheet-shaped object and formed from reflective threads and non-reflective threads by sewing, includes: a plurality of non-reflective regions formed from the non-reflective threads, and a plurality of gaps formed between the plurality of non-reflective regions, with the reflective threads disposed in the plurality of gaps. The reflective threads are exposed from the surface of the sheet-shaped object, allowing the light-reflective pattern to have a light reflection function.

9 Claims, 6 Drawing Sheets

LIGHT-REFLECTIVE PATTERN

BACKGROUND OF THE INVENTION

1. Technical Field

The invention relates to light-reflective patterns, and more particularly to a light-reflective pattern formed from non-reflective threads and reflective threads.

2. Description of Related Art

Reflective threads are provided in clothes such that light falls on the clothes and reflects off the reflective threads, allowing the clothes wearers to have enhanced nocturnal safety but reduced likelihood of nocturnal accidents.

A conventional method of providing reflective threads in clothes entails using the reflective threads as weaving threads for coordinating with other weaving threads in producing fabrics by weaving, allowing the reflective threads to be integrated in the fabrics. Drawbacks of the conventional method are as follows: the reflective threads are embedded in the fabrics thus produced and thereby hidden in the fabrics to the detriment of light reflection effect; the weaving process requires so many reflective threads that high cost is incurred; and the weaving process requires so many reflective threads that the fabrics thus produced are too heavy to achieve high practicability.

Furthermore, the weaving process involves catching and pulling reflective threads; as a result, the reflective threads are likely to get damaged to the detriment of their light reflection function. Last but not least, a pattern formed from reflective threads by weaving exhibits insufficient pattern variations.

BRIEF SUMMARY OF THE INVENTION

It is an objective of the invention to provide a light-reflective pattern formed from reflective threads, with the reflective threads exposed from fabrics or woven materials thus produced, to attain an enhanced light reflection effect, reduce the chance of damaging the reflective threads, and maintain a light reflection function of the reflective threads.

Another objective of the invention is to provide a light-reflective pattern formed from reflective threads to attain an enhanced light reflection effect, reduce the required amount of the reflective threads and the incurred cost, and reduce the weight of fabrics or woven materials thus produced.

Yet another objective of the invention is to provide a light-reflective pattern formed from reflective threads that do not contribute to coarse surfaces of fabrics or woven materials thus produced.

Still yet another objective of the invention is to provide a light-reflective pattern formed from reflective threads, allowing the light-reflective pattern to display rapid pattern variations.

To achieve the above and other objectives, the invention provides a light-reflective pattern, the light-reflective pattern being disposed on a surface of a sheet-shaped object and formed from reflective threads and non-reflective threads by sewing, comprising:

- a plurality of non-reflective regions formed from the non-reflective threads in the light-reflective pattern; and
- a plurality of gaps formed between the plurality of non-reflective regions;

- the reflective threads are disposed in the plurality of gaps respectively and are exposed from the surface of the sheet-shaped object.

Therefore, with the reflective threads being capable of reflecting light, the light-reflective pattern provides a light reflection function to enhance nocturnal safety. The reflective threads are protected by the non-reflective regions to maintain integrity, protecting light reflection elements, such as micro glass beads, of the reflective threads against damage.

Since the reflective threads are not inserted into the sheet-shaped object, the required amount of the reflective threads and the incurred cost are greatly reduced, reducing the weight of the clothes, fabrics and wearables made of the sheet-shaped object and the manufacturing cost. The light-reflective pattern is produced by hand sewing or machine sewing to achieve rapid pattern variations.

Preferably, the two sides of the reflective threads in the gaps adjoin the non-reflective threads of the non-reflective regions. Therefore, the reflective threads have their two sides supported by the non-reflective threads, and thus the reflective threads are steadily positioned on the surface of the sheet-shaped object.

Preferably, top edges of the reflective threads are substantially flush with top edges of the non-reflective threads, and the top edges of the reflective threads do not protrude relative to the top edges of the non-reflective threads, reducing the chance of the reflective threads being touched or damaged.

Preferably, the light-reflective pattern further comprises a plurality of superficial threads disposed on the surface of the sheet-shaped object and adapted to press against the reflective threads to fix the reflective threads to the surface of the sheet-shaped object. The superficial threads press against the reflective threads such that the reflective threads are flush with the fabric surfaces, and in consequence the surfaces of the woven materials or fabrics are not coarse. The whole light-reflective pattern is formed from threads. The reflective threads are flanked by the non-reflective threads. The top edges of the reflective threads are substantially flush with the top edges of the non-reflective threads to not only reduce the chance of the reflective threads being touched but also ensure that the surfaces of woven materials or fabrics are not coarse.

Preferably, one or more than one reflective threads are disposed in each of the plurality of the gaps or in the plurality of the gaps.

In the light-reflective pattern, the reflective threads are in a different color from the non-reflective threads to enhance contrast and visual effect.

The non-reflective regions each have a first width, and the gaps each have a second width, allowing a ratio of the first width to the second width to be in a range of 5:1, preferably in a range of 4:1 or 3:1.

BRIEF DESCRIPTION OF THE DRAWINGS

Objectives, features, and achieved advantages of the invention are herein illustrated with preferred embodiments, depicted with drawings, and described below.

DETAILED DESCRIPTION OF PREFERRED EMBODIMENTS

Figure 1:
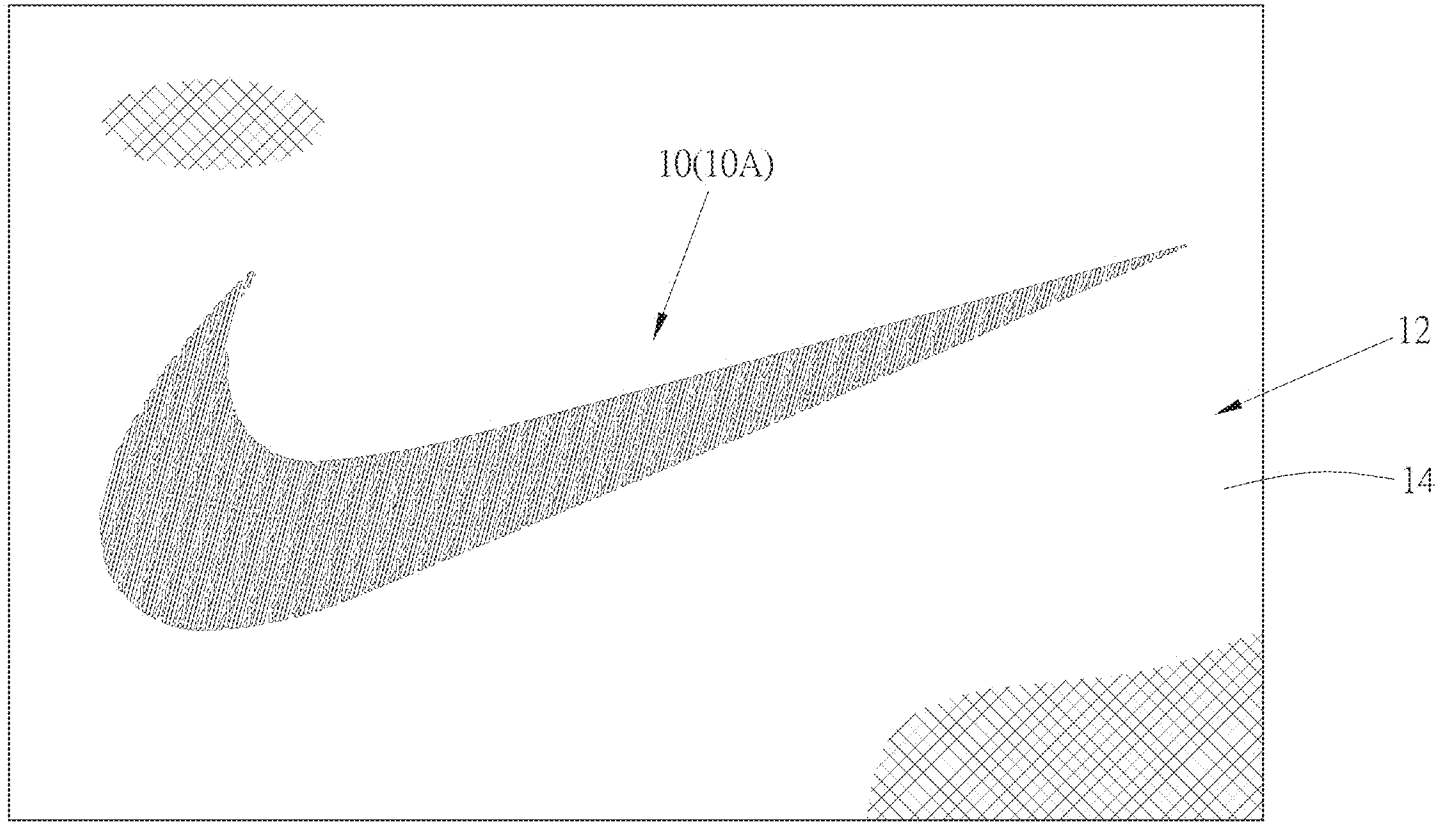
FIG. 1 and FIG. 2 are front views of a light-reflective pattern, exemplified by two logos respectively, according to a preferred embodiment of the invention.
Figure 2:
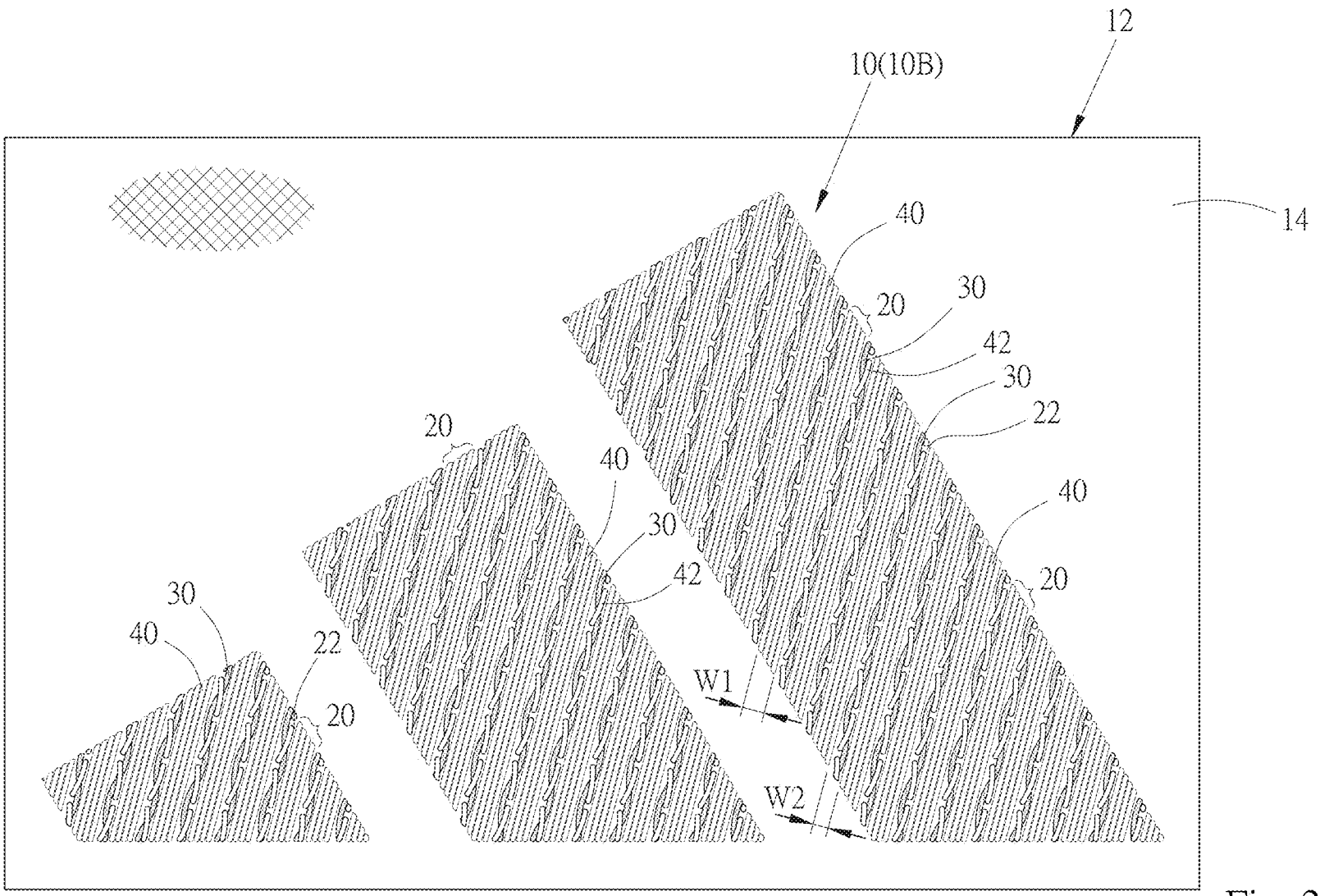

The invention provides a structure for forming a light-reflective pattern 10. The light-reflective pattern 10 is disposed on a surface of a sheet-shaped object 12 and formed from reflective threads and non-reflective threads by sewing. The light-reflective pattern 10 is related to a style, form, symbol or mark, whether meaningful or meaningless, includes a trademark logo or lexical image. For instance, FIG. 1 and FIG. 2 show a light-reflective pattern 10 (10A, 10B), exemplified by NIKE's trademark logo and ADIDAS's trademark logo respectively, according to a preferred embodiment of the invention. The lexical image can be words of any country or numbers, such as the English words NIKE or ADIDAS. FIG. 1 and FIG. 2 is illustrative rather than restrictive of the light-reflective pattern 10 of the invention.

The term "threads" used herein generally refers to various threads, especially threads, yarns, fibers and the like for use with sewing machinery. Thus, the "reflective threads" disclosed herein are, for example, reflective threads, reflective yarns, and reflective fibers, whereas the "non-reflective threads" disclosed herein are, for example, non-reflective threads, non-reflective yarns, and non-reflective fibers. The non-reflective threads disclosed herein do not perform any light reflection function but are exemplified by conventional threads or functional threads, such as noctilucent threads/night glowing threads with a noctilucent/night glowing function, noctilucent yarns/night glowing yarns with a noctilucent/night glowing function, electrically conductive threads with an electrical conduction function, electrically conductive yarns with an electrical conduction function, and electrically conductive fibers with an electrical conduction function. The reflective threads disclosed herein has a light reflection function, i.e., is capable of performing light reflection, and is exemplified by threads whose surfaces are provided with tiny reflective elements, such as micro glass beads. The machine sewing or hand sewing mentioned herein refers to various sewing techniques and sewing methods applicable to sewing machinery, including sewing machines and computer-aided embroidering machines.

The sheet-shaped object 12 disclosed herein is an object that may undergo machine sewing or computer-aided embroidering, and is exemplified by a woven material, such as a fabric. Specifically speaking, the sheet-shaped object 12 includes, but is not limited to, a woven fabric, nonwoven fabric, paper, leather, plastic sheet, plastic film, rubber sheet, and rubber film, which threads can be integrated into through machine sewing or computer-aided embroidering. The sheet-shaped object 12 is a material for use in manufacturing common household items. When the sheet-shaped object 12 is a woven material, it can be processed to make clothes, sportswear, pants, socks, shoes, sneakers, backpacks, hats, name plates, scarves, neckties, neckerchiefs, napkins, and towels. When the sheet-shaped object 12 is leather, it can be processed to make leather jackets, shoes, leather boots, wallets, briefcases, backpacks, hats, and name plates. When the sheet-shaped object 10 is a plastic sheet, plastic film, rubber sheet, or rubber film, it can be processed to make raincoats, rain boots, plastic wallets, bags, backpacks, briefcases, travel bags, and name plates. The sheet-shaped object 12 mentioned herein is exemplified by a fabric.

Figure 4:
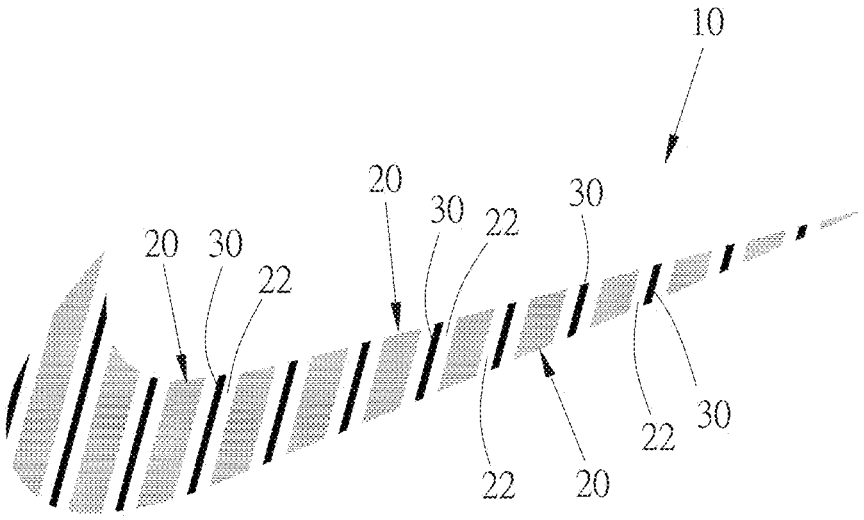
FIG. 4 is a schematic view of composition of the light-reflective pattern of the invention.

Referring to FIG. 4, the light-reflective pattern 10 comprises a plurality of non-reflective regions 20, and a plurality of gaps 22 are formed between the non-reflective regions 20.

Figure 3:
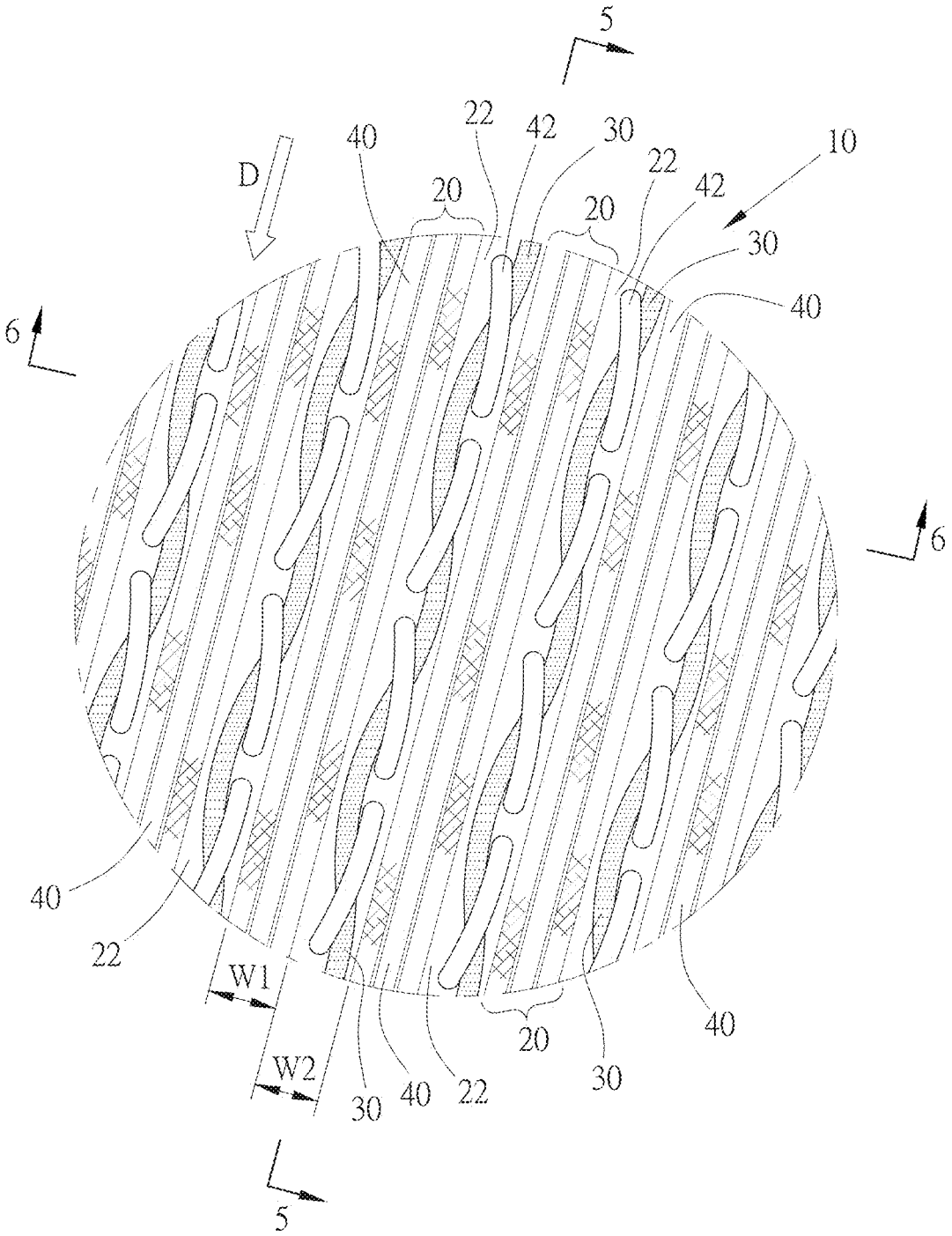
FIG. 3 is a partial enlarged view of FIG. 1.

A plurality of reflective threads 30 are disposed in the gaps 22 respectively. The reflective threads 30 each have a thread diameter of 0.15~0.7 mm, preferably, 0.2~0.6 mm, and more preferably 0.25~0.4 mm. In addition, reflective threads provided with micro glass beads are used in this embodiment. Referring to FIG. 1 through FIG. 3, according to the invention, the reflective threads 30 are disposed on a surface 14 of the sheet-shaped object 12 but are not inserted into or penetrated into the sheet-shaped object 12. The surface 14 is the front of the sheet-shaped object 12, and the other surface 16 of the sheet-shaped object 12 is the back thereof.

Referring to FIG. 1 through FIG. 3, in this embodiment, the non-reflective regions 20 each comprise a plurality of non-reflective threads 40, for example, two to six non-reflective threads 40 (but the invention is not limited to), disposed on the sheet-shaped object 12 through machine sewing techniques, such as computer-aided sewing or computer-aided embroidering. As shown in FIG. 3, the non-reflective regions 20 are each formed from three adjacent, parallel non-reflective threads 40. As shown in FIG. 2, the non-reflective regions 20 are each formed from four adjacent, parallel non-reflective threads 40. The gaps 22 are each formed between two adjacent non-reflective regions 20, and the width of each gap 22 is sufficient to dispose one or more (for example, one to three, or one to five) reflective threads 30. As shown in FIG. 2 and FIG. 3, each gap 22 is disposed therein one reflective thread 30, and the reflective thread 30 is pressed by a superficial thread 42 and thereby fixed to the surface 14 of the sheet-shaped object 12.

Figure 5:
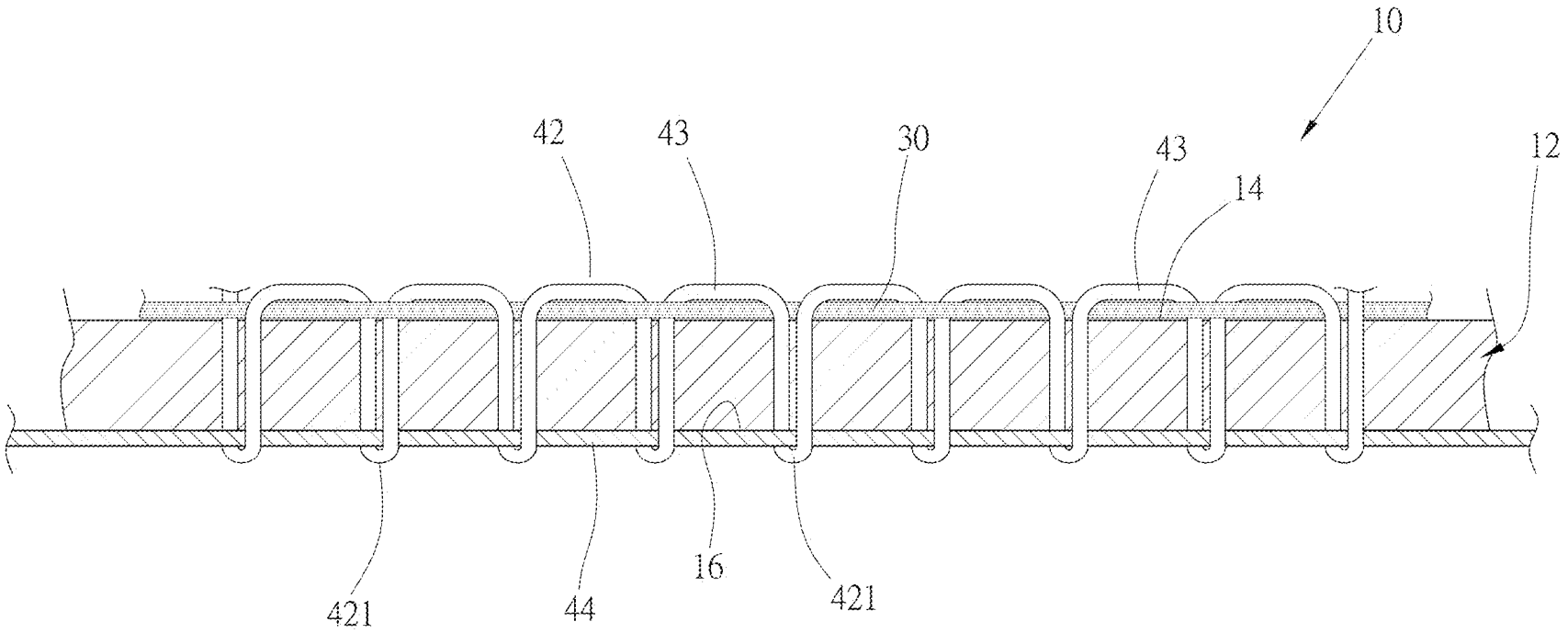
FIG. 5 is a cross-sectional view taken along line 5-5 of FIG. 3, i.e., along the longitudinal direction of reflective threads.

Referring to FIG. 5, the superficial thread 42 is a sewing thread disposed on the sheet-shaped object 12 by sewing machinery and is disposed in a gap 22. The superficial thread 42 penetrates the sheet-shaped object 12 via a surface 14 thereof to reach another surface 16 of the sheet-shaped object 12. Next, the superficial thread 42 folds to form a bend portion 421 for catching a bottom thread 44 (a sewing thread) and then penetrates the sheet-shaped object 12 via the surface 16 to return to the surface 14. Thus, the superficial thread 42 forms a plurality of stitches 43 on the surface 14 of the sheet-shaped object 12 and thereby presses against the reflective threads 30. Referring to FIG. 2 and FIG. 3, the reflective threads 30 disposed in the gaps 22 are fixed in place by the superficial threads 42 and the bottom threads 44 respectively. In practice, one superficial thread can press against a plurality of reflective threads.

Figure 6:
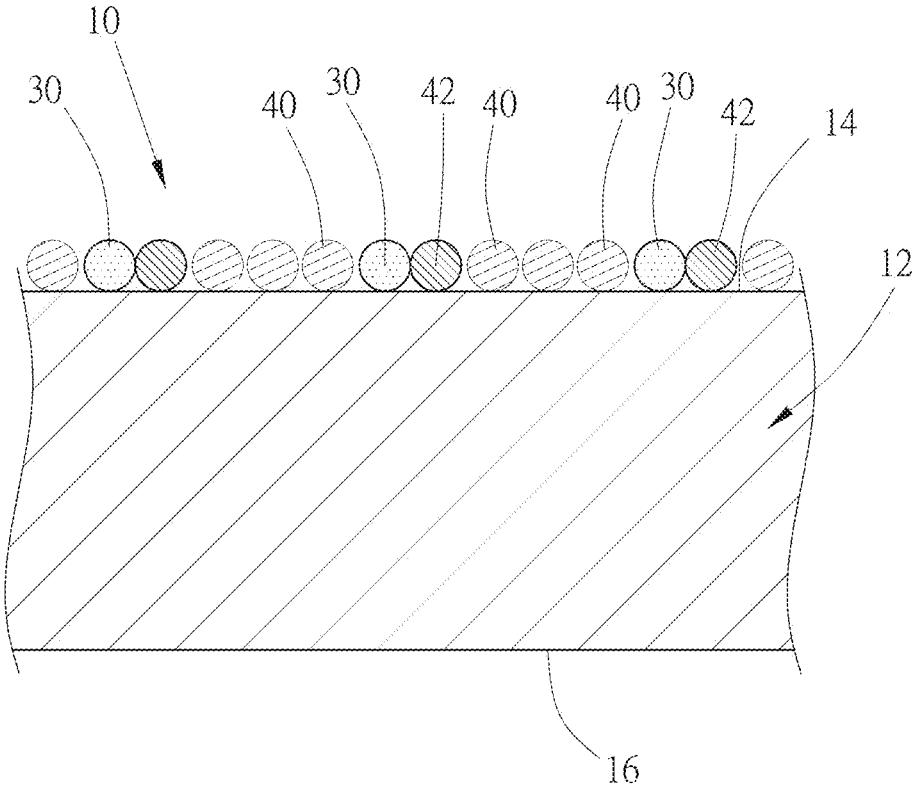
FIG. 6 is a cross-sectional view taken along line 6-6 of FIG. 3, i.e., along the radial direction of reflective threads.

Referring to FIG. 5 and FIG. 6, in this embodiment, the stitches 43 of the superficial thread 42 press against the reflective threads 30 to allow the reflective threads 30 to be attached to the surface 14 of the sheet-shaped object 12 such that the top edges of the reflective threads 30 are flush with or substantially flush with the top edges of the non-reflective threads 40 but do not protrude relative to the non-reflective threads 40, reducing the chance of the reflective threads 30 being touched.

The reflective threads 30 are in the same color as or in a different color from the non-reflective threads 40 to augment contrast and render the light-reflective pattern 10 colorful and variable.

In an embodiment of the invention, the non-reflective regions 20 each have a first width W1, and the gaps 22 each have a second width W2. The ratio of the first width W1 to the second width W2 is within the range of 5:1, preferably within the range of 4:1 or 3:1, and more preferably within the range of 2:1 or 1.2:1.

FIG. 1 through FIG. 4 show that the reflective threads 30 are disposed in the gaps 22 of the light-reflective pattern 10 respectively. In practice, the reflective threads 30 are disposed in the plurality of gaps 22, for example, the light-reflective pattern has 20 gaps, and only 10 or 16 gaps have the reflective threads. At least half of the gaps have the reflective threads.

In the embodiment illustrated by FIG. 1 through FIG. 3, the sewing direction (processing direction) D of the non-reflective threads 40 is the same as the sewing direction (processing direction) of the reflective threads 30.

Figure 7:
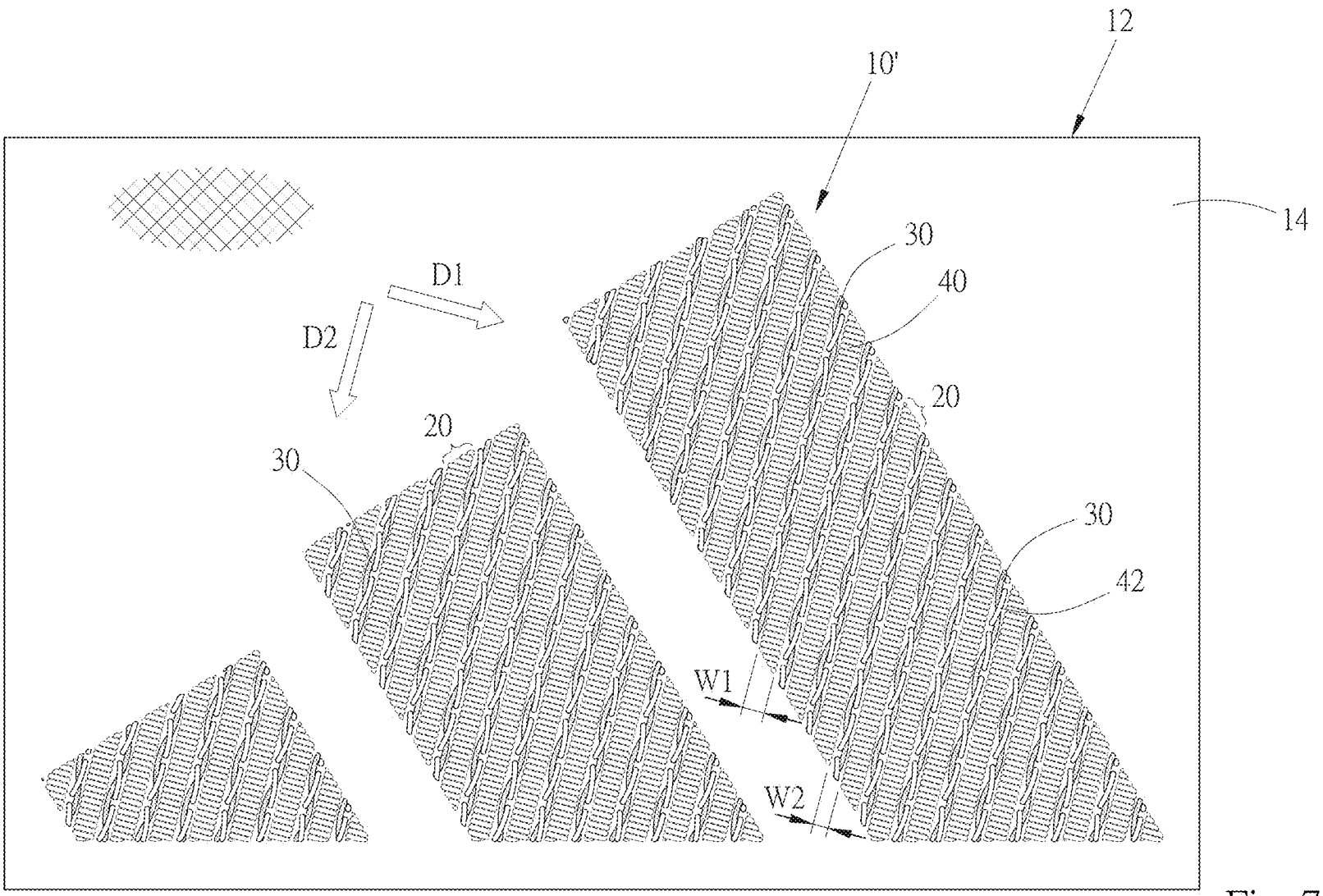
FIG. 7 is a front view of the light-reflective pattern according to the second preferred embodiment of the invention.

FIG. 7 depicts the second preferred embodiment of a light-reflective pattern 10' of the invention. Likewise, the light-reflective pattern 10' comprises a plurality of non-reflective regions 20 formed from non-reflective threads 40, a plurality of gaps 22 disposed between the non-reflective regions 20, and a plurality of reflective threads 30 disposed in the gaps 22. The reflective threads 30 are pressed by the superficial threads 42 and fixed to a surface 14 of the sheet-shaped object 12. Each of the non-reflective regions 20 is formed by adjacent, parallel non-reflective threads 40. In this embodiment, the sewing direction (processing direction) D1 of the non-reflective threads 40 is different from the sewing direction (processing direction) D2 of the reflective threads 30.

The light-reflective pattern 10 (10') of the invention has some advantages. For example, the reflective threads 30 are directly exposed from the surface 14 of the sheet-shaped object 12, such as a fabric or a woven fabric, but are not inserted and hidden in the sheet-shaped object 12, with a view to achieving an enhanced light reflection function, and prevent the reflective threads from being damaged.

The reflective threads 30 are exposed from the surface of the sheet-shaped object 12. Since the reflective threads 30 are not inserted into the sheet-shaped object 12, the required amount of the reflective threads and the incurred cost are greatly reduced, effectively reducing the weight of the sheet-shaped object and the weight of the clothes, fabrics and wearables made of the sheet-shaped object.

The non-reflective regions 20 of the light-reflective pattern 10 is conducive to the protection of the reflective threads 30 from touch and damage and the reduction of the chance of micro glass beads falling off so as to maintain the integrity of the reflective threads and the integrity of the light reflection function.

The non-reflective threads 40 undergo embroidering or sewing so as to be integrated into the sheet-shaped object 12 to form a stable structure. The two sides of the reflective threads 30 adjoin the non-reflective threads 40. Therefore, the reflective threads 30 have their two sides supported by the non-reflective threads 40, and thus the reflective threads 30 are steadily positioned on the surface 14 of the sheet-shaped object 12.

The reflective threads 30 in the light-reflective pattern 10 are spaced apart from each other. Light falls on the light-reflective pattern 10 and reflects off the reflective threads 30 in the light-reflective pattern 10. The shadiness of the reflected light ensures that the graphics of the light-reflective pattern 10 is completely visible. The invention not only provides a light reflection function but also protects the reflective threads 30 against damage.

The non-reflective regions 20 of the light-reflective pattern 10 (10A, 10B, 10') are formed by embroidering and thus have a thickness. Moreover, the reflective threads 30 have a thickness. Thus, the light-reflective pattern 10 is three-dimensional and solid and provides three-dimensional images.

In an embodiment of the invention, the superficial threads press against the reflective threads such that the reflective threads are flush with the fabric surfaces, and in consequence the surfaces of the woven materials or fabrics are not coarse. The whole light-reflective pattern 10 is formed from threads (reflective threads and non-reflective threads). The reflective threads are flanked by the non-reflective threads. The top edges of the reflective threads are substantially flush with the top edges of the non-reflective threads to not only reduce the chance of the reflective threads being touched but also ensure that the surfaces of woven materials or fabrics are not coarse.

The light-reflective pattern 10 is formed from threads and thus does not conceal pores of fabrics, ensuring air permeability.

The light-reflective pattern 10 can be integrated into wearables or common household items to ensure user safety.

The light-reflective pattern of the invention is formed through computer-aided sewing or computer-aided embroidering to achieve rapid pattern variations and reduce the cost incurred.

Although the invention has been disclosed as above with the embodiments, it is not intended to limit the invention. A person having ordinary skill in the art to which the invention pertains can make various changes and modifications without departing from the spirit and scope of the invention. Therefore, scope of protection of the invention shall be subject to what is defined in the pending claims.

What is claimed is:

1. A light-reflective pattern, disposed on a surface of a sheet-shaped object and formed from reflective threads and non-reflective threads which are sewn onto the sheet-shaped object, comprising:

a plurality of non-reflective regions formed from the non-reflective threads in the light-reflective pattern; and a plurality of gaps formed between the plurality of non-reflective regions;

the reflective threads are disposed in the plurality of gaps and are exposed from the surface of the sheet-shaped object.

2. The light-reflective pattern as claimed in claim 1, wherein the reflective threads are not inserted into the sheet-shaped object.

3. The light-reflective pattern as claimed in claim 1, wherein two sides of the reflective threads disposed in the gaps are supported by the non-reflective threads.

4. The light-reflective pattern as claimed in claim 1, wherein top edges of the reflective threads are substantially flush with top edges of the non-reflective threads.

5. The light-reflective pattern as claimed in claim 1, further comprising a plurality of superficial threads disposed on the surface of the sheet-shaped object and located in the plurality of gaps, with the reflective threads pressed by the superficial threads.

6. The light-reflective pattern as claimed in claim 5, further comprising a plurality of bottom threads disposed on another surface of the sheet-shaped object, and the superficial threads penetrate the sheet-shaped object and catch the bottom threads.

7. The light-reflective pattern as claimed in claim 1, wherein the reflective threads are in a different color from the non-reflective threads.

8. The light-reflective pattern as claimed in claim 1, wherein at least one reflective thread is disposed in each of the plurality of the gaps or in the plurality of the gaps.

9. The light-reflective pattern as claimed in claim 1, wherein the non-reflective regions each have a first width, and the gaps each have a second width, and a ratio of the first width to the second width is within the range of 5:1.

* * * * *